US008552912B2

(12) United States Patent
Wang et al.

(10) Patent No.: US 8,552,912 B2
(45) Date of Patent: Oct. 8, 2013

(54) ANTENNA FOR THIN COMMUNICATION APPARATUS

(75) Inventors: Ching-Sung Wang, Taoyuan County (TW); Min-Che Chen, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 381 days.

(21) Appl. No.: 12/269,888

(22) Filed: Nov. 13, 2008

(65) Prior Publication Data

US 2009/0128426 A1 May 21, 2009

(30) Foreign Application Priority Data

Nov. 15, 2007 (TW) ..... 96143267 A

(51) Int. Cl.
*H01Q 1/24* (2006.01)
*H01Q 9/38* (2006.01)
*H01Q 9/30* (2006.01)

(52) U.S. Cl.
USPC ..... 343/702; 343/828; 343/829; 343/846

(58) Field of Classification Search
USPC ..... 343/702, 828, 829, 846
See application file for complete search history.

(56) References Cited

U.S. PATENT DOCUMENTS 6,498,586 B2 12/2002 Pankinaho
6,515,629 B1 * 2/2003 Kuo et al. ..... 343/700 MS
6,759,991 B2 7/2004 Boyle
6,911,945 B2 6/2005 Korva
7,132,987 B1 * 11/2006 Olsson et al. ..... 343/702
7,193,564 B2 * 3/2007 Takagi et al. ..... 343/700 MS
2004/0085244 A1 * 5/2004 Kadambi et al. ..... 343/700 MS
2006/0044196 A1 * 3/2006 Grant et al. ..... 343/713
2006/0145924 A1 7/2006 Chen et al.
2006/0197705 A1 * 9/2006 Chen et al. ..... 343/700 MS
2007/0030198 A1 * 2/2007 Wei ..... 343/700 MS
2010/0214191 A1 * 8/2010 Teng et al. ..... 343/843

FOREIGN PATENT DOCUMENTS

CN 2727983 9/2005
TW 575979 2/2004

OTHER PUBLICATIONS

"Antenna Frequency Scaling," The ARRL Antenna Book, published by The American Radio Relay League, Copyright 1988, p. 2-24 to 2-25.*
"Office Action of Taiwan Counterpart Application," issued on Oct. 21, 2010, p. 1-p. 7, in which the listed references were cited.
"First Office Action of China Counterpart Application", issued on Feb. 3, 2012, p. 1-p. 5, in which the listed reference was cited.

* cited by examiner

*Primary Examiner* — Jacob Y Choi
*Assistant Examiner* — Graham Smith
(74) *Attorney, Agent, or Firm* — Jianq Chyun IP Office

(57) ABSTRACT

A PIFA for a thin communication apparatus is provided. The PIFA includes a main body, a ground area and two ground segments, wherein the ground segments are adjacent with each other and extending out from a same side of the ground area. The SAR value and a required height for setting the antenna can be reduced through the design of two grounding paths on the antenna.

16 Claims, 4 Drawing Sheets

ANTENNA FOR THIN COMMUNICATION APPARATUS

CROSS-REFERENCE TO RELATED APPLICATION

This application claims the priority benefit of Taiwan application serial no. 96143267, filed on Nov. 15, 2007. The entirety of the above-mentioned patent application is hereby incorporated by reference herein and made a part of this specification.

BACKGROUND OF THE INVENTION

1. Field of the Invention

The present invention relates to an inverted F antenna (PIFA). More particularly, the present invention relates to a multi-band PIFA for a thin communication apparatus.

2. Description of Related Art

Design features of handheld 3G (3rd generation) communication apparatuses such as cell phones have a general trend of lightness, slimness, shortness and smallness. Therefore, a conventional antenna design has become inapplicable for accomplishment of above features. To design a broadband antenna, limitation of height thereof is a challenge.

There are two general methods for designing the antenna for wireless communication products on the market. One is a PIFA, which has a commonly used antenna structure, which includes a main body, a feed point and a ground point, by which a plurality of required resonant frequencies may be obtained via two current paths with different lengths. Another one is a so-called monopole antenna, which has a clearance region to avoid interference of antenna effect occurred due to excessive closed electronic components during operation, such that the antenna may be operated under an optimal bandwidth.

As to the PIFA, limitation of the height (a spacing distance between the main body and a circuit substrate) is a great challenge. If the PIFA were to be built within a slim, multi-band handheld communication apparatus, the bandwidth thereof may become a great problem. If the monopole antenna is applied in the slim handheld communication apparatus, the circuit substrate is required to provide a complete clearance region for utilization of the antenna, such that size of the apparatus is increased, meanwhile, utilization of such antenna is influenced by excessive specific absorption ratio (SAR) of human body and phantom.

SUMMARY OF THE INVENTION

The present invention is directed to an antenna for a thin communication apparatus, by which SAR value and a required height for setting the antenna may be reduced, and bandwidth of the antenna may be improved by two grounding paths of the antenna.

The present invention provides a PIFA including a main body, a ground area, a first ground segment and a second ground segment. The first ground segment and the second ground segment extend out from a same side of the ground area for connecting to the ground, and the two ground segments do not contact with each other. In other words, the first ground segment and the second ground segment provides two grounding paths for the antenna.

In an embodiment of the present invention, the first ground segment and the second ground segment are adjacent with each other and disposed on a same side of the ground area, and a feed line is disposed on another side of the ground area.

In an embodiment of the present invention, a preferable distance between the first ground segment and the second ground segment is between 1 mm and 10 mm.

In an embodiment of the present invention, a preferable width of the first ground segment and the second ground segment is equal to or less than 2 mm.

In an embodiment of the present invention, the antenna further includes a feed line connected to the ground area for transmitting signals transmitted and received by the main body.

In an embodiment of the present invention, the main body includes a first radiation area and a second radiation area. The first radiation area is connected to the ground area and has a first plane and a second plane, wherein the second plane is a bending part of the first plane. The second radiation area is connected to the first radiation area and has a third plane and a fourth plane, wherein the fourth plane is a bending part of the third plane. The first radiation area and the second radiation area form the main body.

In an embodiment of the present invention, the first plane is vertical to the second plane, the third plane is vertical to the fourth plane, the first plane and the fourth plane are located in a same plane, and the second plane and the third plane are located in a same plane.

The present invention provides a communication apparatus including a circuit substrate and the aforementioned PIFA. The circuit substrate has a common ground terminal and a signal receiving terminal for respectively providing a ground level and a signal transmission terminal located between the PIFA and the circuit substrate. The first ground segment and the second ground segment of the PIFA may be a spring contacting the common ground terminal, and the feed line may also be a spring contacting the signal receiving terminal.

The main body of the PIFA and the two grounding paths are combined in a design of the antenna structure of the present invention, by which the SAR value and the required spacing height between the PIFA and the circuit substrate are reduced. Moreover, the antenna of the present invention is a multi-band antenna with an operation band covering the operation band of 3G communication system, which may be from 824 MHz to 894 MHz, from 1710 MHz to 1880 MHz, from 1850 MHz to 1990 MHz and from 1920 MHz to 2170 MHz.

In order to make the aforementioned and other objects, features and advantages of the present invention comprehensible, a preferred embodiment accompanied with figures is described in detail below.

DESCRIPTION OF EMBODIMENTS

Figure 1:
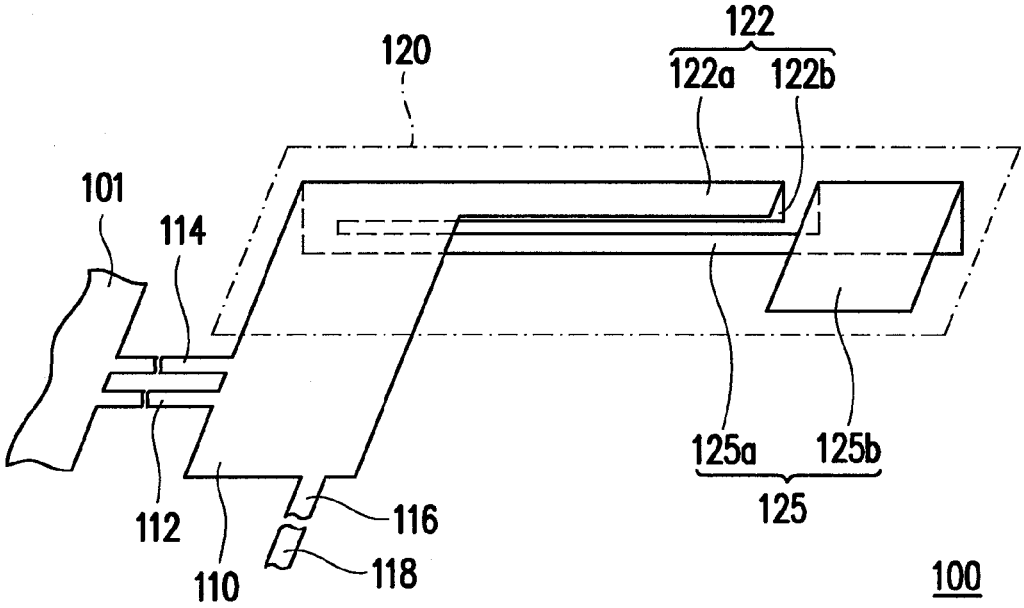
FIG. 1 is a structural diagram of an antenna according to an embodiment of the present invention.

FIG. 1 is a structural diagram of an antenna according to an embodiment of the present invention. A PIFA 100 includes a ground area 110, ground segments 112 and 114, a feed line 116 and a main body 120. The ground segments 112 and 114 are disposed adjacent to each other and has no connection there between, and the ground segments 112 and 114 extend out from a same side of the ground area 110 to connect to a common ground terminal 101 used for providing a ground level. In other words, the ground segments 112 and 114 provide two grounding paths between the ground area 110 and the common ground terminal 101 of the antenna 100. The feed line 116 extends out from another side of the ground area 110 as shown in FIG. 1 for connecting to a signal receiving terminal 118. In a communication apparatus (such as a cell phone), the common ground terminal 101 and the signal receiving terminal 118 are all disposed on a circuit substrate (not shown). The common ground terminal 101 provides a ground level, and the signal receiving terminal 118 provides a signal transmission path between the circuit substrate and the antenna 100, namely, the circuit substrate may transmit a signal to the antenna 100 via the signal receiving terminal 118, so as to send the signal to external environment, and the antenna 100 may transmit the signal received from external environment to the circuit substrate via the signal receiving terminal 118.

Referring to FIG. 1, in the present embodiment, the two ground segments 112 and 114 are applied to form the two grounding paths, such that the antenna 100 may have lower reflection coefficient value and standing wave ratio (SWR) when being operated under high operation band, and meanwhile a required spacing height (a distance between the main body 120 and the circuit substrate) between the antenna 100 and the circuit substrate is reduced. Moreover, if the antenna 100 of the present embodiment is applied to a thin cell phone, influence of SAR value and phantom to the antenna may be effectively reduced.

In the present embodiment, the main body 120 further includes a first radiation area 122 and a second radiation area 125, and different lengths and structures of the first radiation area 122 and the second radiation area 125 may form different current paths, so as to form the main body 120 capable of responding to a plurality of signal bands (for example, 824~894 MHz and 1710~2170 MHz). The first radiation area 122 may respond to relatively high bands (for example, 1710~2170 MHz), and has a first plane 122*a* and a second plane 122*b* formed by a bending part of the first plane 122*a*. The first plane 122*a* is vertical to the second plane 122*b*. The second radiation area 125 may respond to relatively low bands (for example, 824~894 MHz), and has a third plane 125*a* and a fourth plane 125*b* formed by a bending part of the third plane 125*a*. The third plane 125*a* is vertical to the fourth plane 125*b*. In the present embodiment, the second plane 122*b* and the third plane 125*a* are located in a same plane, and the first plane 122*a*, the fourth plane 125*b* and the ground area 110 are located in a same plane, as shown in FIG. 1.

Figure 2A:
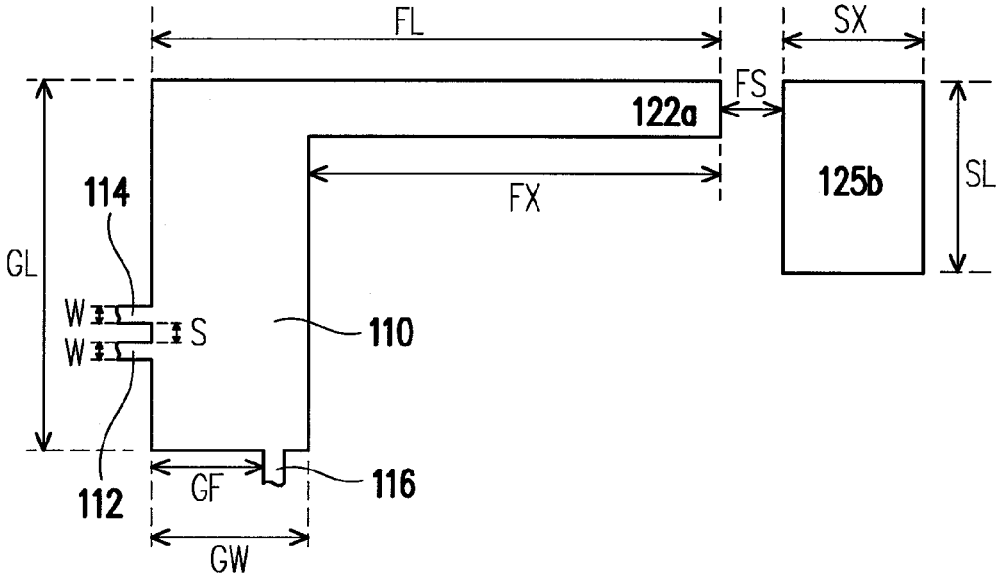
FIG. 2A is a top view of an antenna according to an embodiment of the present invention.
Figure 2B:
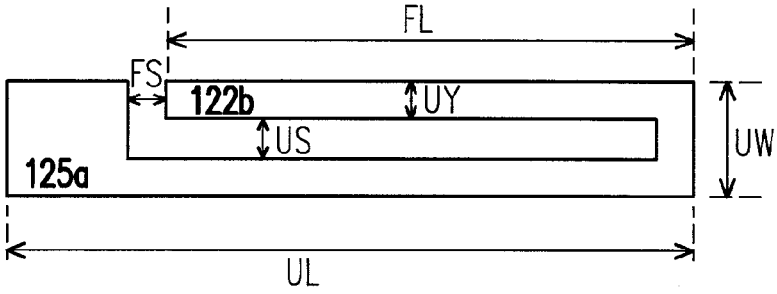
FIG. 2B is a side view of an antenna according to an embodiment of the present invention.

Structure and specification of the antenna 100 are further described with reference of FIG. 2A and FIG. 2B. FIG. 2A is a top view of an antenna according to an embodiment of the present invention. FIG. 2B is a side view of an antenna according to an embodiment of the present invention. Referring to FIG. 2A and FIG. 2B, parameters GW, GL, GF, W, S, FL, FX, FS, SX, SL, UW, UY, UL and US are used for representing lengths of different parts of the antenna 100. In the present embodiment, the above parameters are shown in table 1:

TABLE 1

| | Referential No. | | | | | | | | | | | | | |
|---|---|---|---|---|---|---|---|---|---|---|---|---|---|---|
| | GW | GF | GL | W | S | FL | FX | FS | SX | SL | UW | UY | UL | US |
| length (mm) | 11 | 7 | 16 | 1 | 1 | 32 | 21 | 2 | 11 | 11 | 5 | 2.5 | 45 | 1 |

The parameters included within the table 1 are only an embodiment of the present invention, and the present invention is not limited thereto. The parameters may be adjusted according to an actual requirement of features of the antenna. Moreover, it should be noted that the parameter S represents a spacing between the ground segments 112 and 114, which is preferably within a range of 1 mm to 10 mm, and the width W of the ground segments 112 and 114 is preferably less than 2 mm.

Figure 3:
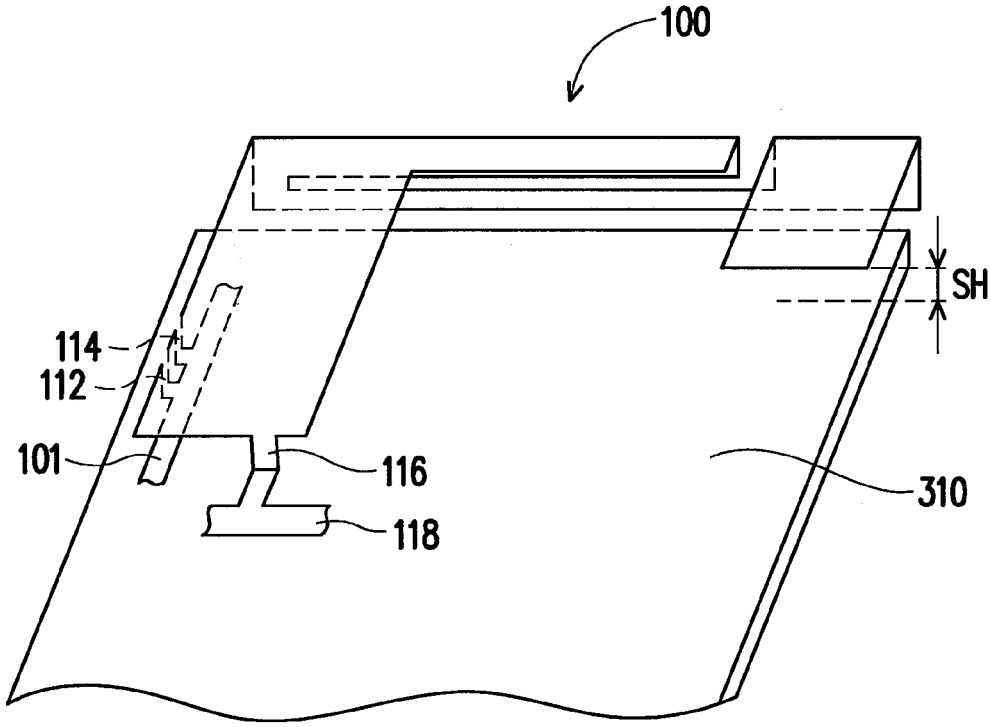
FIG. 3 is a schematic diagram of a communication apparatus according to an embodiment of the present invention.

FIG. 3 is a schematic diagram of a communication apparatus according to an embodiment of the present invention. The communication apparatus includes the aforementioned PIFA antenna 100 and a circuit substrate 310 integrated with a plurality of electronic components (not shown). The antenna 100 is connected to the circuit substrate 310 via the ground segments 112 and 114 and the feed line 116. The ground segments 112 and 114 are connected to the common ground terminal 101 on the circuit substrate 310 for providing the antenna 100 a ground level, and the feed line 116 is connected to the signal receiving terminal 118 of the circuit substrate 310 for providing a signal transmission path between the circuit substrate 310 and the antenna 100.

According to the characteristics of the PIFA, a spacing height SH is required between a portion (for example, the first plane 122*a*, the fourth plane 125*b* and the ground area 110) of the antenna 100 and the circuit substrate 310, so as to achieve a maximum bandwidth. However, since two grounding paths (i.e. the ground segments 112 and 114) without connection there between are provided between the antenna 100 and the circuit substrate 310 in the present embodiment, and according to an experiment result, the spacing height SH of the present embodiment is substantially smaller than the spacing height between the conventional PIFA and the circuit substrate, and meanwhile efficiency of the antenna is improved, and the SAR value is greatly reduced due to change of radiation field of the antenna. In addition, it should be noted that the ground segments 112 and 114, and the feed line 116 of the present embodiment may all be contacted to the circuit substrate in a spring mode. The springs are a part of radiator of the antenna, and the cost of the spring is far more less than that of a pogo-pin generally used within the cell phone antenna. FIG. 1, FIG. 2A, FIG. 2B and FIG. 3 are diagrams illustrating different views of the antenna 100, and the table 1 provides reference values of the parameters. Therefore, those skilled in the art may deduce other feasible structures and parameters easily according to the disclosure of the present invention, and the detailed description thereof will not be repeated.

Figure 4:
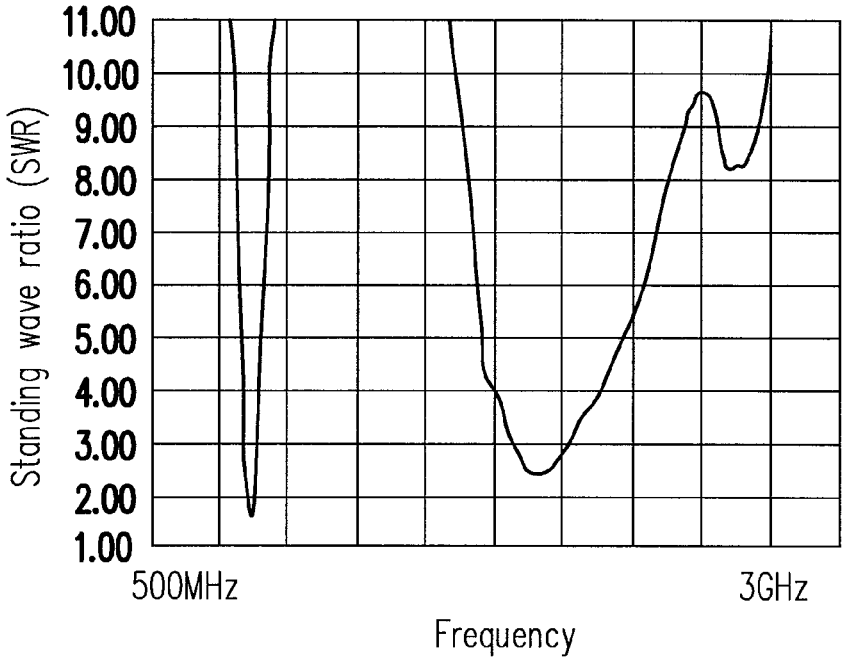
FIG. 4 is a diagram illustrating a standing wave ratio of an antenna according to the present embodiment.

Since a monopole antenna requires a clearance region to achieve the maximum bandwidth, during operation of the communication apparatus, if the monopole antenna is excessively closed to human head, the SAR value will be high. Though the PIFA may reduce the influence of the SAR value and the phantom, when a setting height between the PIFA and the circuit substrate is about 4.5 mm, the bandwidth thereof cannot match a requirement of 3G (3rd generation, the third generation cell phone communication technique). In the present embodiment, because of two grounding paths, the required spacing height between the PIFA and the circuit substrate may be smaller than that between the conventional PIFA and the circuit substrate, and the spacing height may be reduced to around 4.5 mm. The antenna 100 of the present embodiment is a novel antenna suitable for the 3G band. FIG. 4 is a diagram illustrating a standing wave ratio of an antenna according to the present embodiment. As shown in FIG. 4, the antenna 100 has two operation bands, which are respectively from 824 MHz to 894 Mhz and from 1710 MHz to 2170 MHz, so as to match the required operation bands of 3G cell phone.

In summary, the present invention provides a novel PIFA with two grounding paths, by which the antenna bandwidth is increased, and the height of the antenna (i.e. the spacing height between the antenna and the circuit substrate, and in the present embodiment, the required spacing height is about 4.5 mm) is reduced. Since the antenna of the present invention is a broadband antenna, it may be applied to the present 3G system bands, which may range from 824 MHz to 894 MHz, from 1710 MHz to 1880 MHz, from 1850 MHz to 1990 MHz and from 1920 MHz to 2170 MHz.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A planar inverted F antenna (PIFA), comprising:

a main body, including a first radiation area and a second radiation area, wherein the first radiation area is directly extending out from a ground area and is directly connected to the second radiation area and is bent in a first direction perpendicular to the ground area to form a first plane and a second plane, the first plane and the second plane form a three dimensional structure, the second radiation area which is not directly connected with the ground area is directly extending out from the second plane and bent in a second direction parallel to the ground area to form a third plane and a fourth plane, and the third plane and the fourth plane form the three dimensional structure;

a first ground segment, directly extending out from the ground area directly-electrically connected to the main body for connecting to ground; and a second ground segment, directly extending out from the ground area directly-electrically connected to the main body for connecting to the ground, wherein the first ground segment and the second ground segment are parallel with each other, a spacing distance between the first ground segment and the second ground segment is between 1 mm and 10 mm, and a width of at least one of the first ground segment and the second ground segment is less than 2 mm.

2. The PIFA as claimed in claim 1, wherein the first ground segment and the second ground segment extend out from a same side of the ground area.

3. The PIFA as claimed in claim 1 further comprising a feed line extending out from the ground area for transmitting signals transceived by the main body.

4. The PIFA as claimed in claim 3, wherein the first ground segment and the second ground segment extend out from a same side of the ground area, and the feed line extends out from another side of the ground area.

5. The PIFA as claimed in claim 1, wherein the first radiation area is connected to the ground area and capable of responding to a first band, and the second radiation area is capable of responding to a second band.

6. The PIFA as claimed in claim 5, wherein the first band is between 1710 MHz and 2170 MHz.

7. The PIFA as claimed in claim 5, wherein the second band is between 824 MHz and 894 MHz.

8. The PIFA as claimed in claim 1, wherein at least one of the first ground segment and the second ground segment comprises a spring.

9. A communication apparatus, comprising:

a circuit substrate, having a common ground terminal and a signal receiving terminal;

a planar inverted F antenna (PIFA), comprising:

a ground area;

a main body, including a first radiation area and a second radiation area, wherein the first radiation area is directly extending out from the ground area and is directly connected to the second radiation area and is bent in a first direction perpendicular to the ground area to form a first plane and a second plane, the second radiation area which is not directly connected with the ground area is directly extending out from the second plane and bent in a second direction parallel to the ground area to form a third plane and a fourth plane, and a distance exists between the circuit substrate and at least the first plane and the fourth plane;

a first ground segment, directly extending out from the ground area directly-electrically connected to the main body for connecting to the common ground terminal; and a second ground segment, directly extending out from the ground area directly-electrically connected to the main body for connecting to the common ground terminal, wherein the first ground segment and the second ground segment are parallel with each other, a spacing distance between the first ground segment and the second ground segment is between 1 mm and 10 mm, and a width of at least one of the first ground segment and the second ground segment is less than 2 mm.

10. The communication apparatus as claimed in claim 9, wherein the first ground segment and the second ground segment extend out from a same side of the ground area.

11. The communication apparatus as claimed in claim 9 further comprising a feed line extending out from the ground area, and connected to the signal receiving terminal for transmitting signals between the PIFA and the circuit substrate.

12. The communication apparatus as claimed in claim 11, wherein the first ground segment and the second ground segment extend out from a same side of the ground area, and the feed line extends out from another side of the ground area.

13. The communication apparatus as claimed in claim 9, wherein the first radiation area is connected to the ground area and capable of responding to a first band, and the second radiation area is capable of responding to a second band.

14. The communication apparatus as claimed in claim 13, wherein the first band is between 1710 MHz and 2170 MHz or the second band is between 824 MHz and 894 MHz.

15. The communication apparatus as claimed in claim 9, wherein at least one of the first ground segment and the second ground segment comprises a spring contacting the common ground terminal.

16. The communication apparatus as claimed in claim 9, wherein a distance between the ground area and the circuit substrate is about 4.5 mm.

* * * * *